US005153550A

United States Patent [19]

Sugiura et al.

[11] Patent Number: 5,153,550

[45] Date of Patent: Oct. 6, 1992

[54] COIL ASSEMBLY FOR ELECTROMAGNETIC VALVES

[75] Inventors: Kiyohiko Sugiura, Hekinan; Nobuaki Miki, Kariya; Takeshi Nasu; Masayuki Sugiura, both of Anjo; Masao Saito, Nishio, all of Japan

[73] Assignee: Aisin AW Co., Ltd., Japan

[21] Appl. No.: 633,616

[22] Filed: Dec. 28, 1990

[30] Foreign Application Priority Data

Dec. 29, 1989 [JP] Japan ..... 1-342171

[51] Int. Cl.[5] ..... H01F 27/02; H01F 15/10; H01F 27/04

[52] U.S. Cl. ..... 336/192; 336/90; 336/107

[58] Field of Search ..... 336/90, 192, 107; 335/278

[56] References Cited

U.S. PATENT DOCUMENTS

| | | | |
|---|---|---|---|
| 4,720,078 | 1/1988 | Nakamura | 335/292 |
| 4,728,916 | 3/1988 | Fontecchio et al. | 335/255 |
| 4,954,801 | 9/1990 | Urbanski et al. | 336/90 |

*Primary Examiner*—Leo P. Picard
*Assistant Examiner*—Raymond Barrera
*Attorney, Agent, or Firm*—Lorusso & Loud

[57] ABSTRACT

A coil assembly for an electromagnetic valve to be used in a vehicular hydraulic control circuit. The coil assembly includes an electromagnetic coil, a coil bobbin wound with the electromagnetic coil and having a flange, a terminal holder molded integrally with the flange of the coil bobbin, connection terminals fixed to the terminal holder, an insulating casing covering the coil bobbin and a terminal housing molded integrally with the insulating casing for covering the terminal holder and receiving the connection terminals to form a male connector terminal.

3 Claims, 5 Drawing Sheets

COIL ASSEMBLY FOR ELECTROMAGNETIC VALVES

BACKGROUND OF THE INVENTION

1. Field of the Invention

The present invention relates to a coil assembly for an electromagnetic valve to be used in a vehicular hydraulic control circuit and, more particularly, to a coil device to be used especially in a linear solenoid or an electromagnetic valve.

2. Description of the Prior Art

FIG. 13 is a section showing an electromagnetic coil assembly of the prior art before forming the resin molding around same; FIG. 14 is a view taken in the direction of arrows A—A of FIG. 13; FIG. 15 is a section showing the electromagnetic coil device after the resin-molding operation; and FIG. 16 is a view taken in the direction of arrows B—B of FIG. 15.

The electromagnetic coil device to be embedded in molding resin is prepared as shown in FIGS. 13 and 14, by winding the electromagnetic coil 2 around the coil bobbin 1 and by fixing a connector terminal 4 and a ground terminal 5 to one end of the coil bobbin 1. Moreover, the leads 3 of the electromagnetic coil 2 are connected with the individual fusing portions 6 of terminals 4 and 5, and an insulating tape (although not shown) is wound on the outermost circumference of the wound electromagnetic coil 2. Moreover, the electromagnetic coil 2 wound on the coil bobbin 1 is sometimes impregnated with varnish for its protection. The connector terminal 4 of the electromagnetic coil device thus assembled is bent 90° (as indicated by dotted lines in FIG. 13), and the whole device is coated with a molding resin 7, excepting portions of the connector terminal 4 and the ground terminal 5, as shown in FIGS. 15 and 16, to produce the resin-embedded coil device.

However, it is difficult to wind the insulating tape properly to protect the electromagnetic coil. Moreover, unless the insulating tape is properly positioned upon wrapping, it may cause damage to the electromagnetic coil and/or tear or break the insulation when the coil bobbin is covered with the metal casing. If impregnation with varnish is used to protect the electromagnetic coil and if the coil wrapping is not properly positioned, the varnish coating of the electromagnetic coil may also be damaged when the coil bobbin is assembled with the metal casing, creating a possibility of insulation failure.

With such a resin-covered coil device, moreover, the electromagnetic coil is subject to thermal shock. Further, the heat generated by the electromagnetic coil is not transferred efficiently by the molding resin, creating a problem of heat dissipation.

SUMMARY OF THE INVENTION

It is, therefore, an object of the present invention to solve the above-specified problems and to provide a coil device for use in an electromagnetic valve, which is assembled by fitting a separately formed casing on a coil bobbin, after the coil bobbin has been wound with an electromagnetic coil, so that it can be easily and reliably protected.

In order to achieve the above-specified objectives, according to the present invention, there is provided a coil assembly for an electromagnetic valve for use in a vehicular hydraulic control circuit. The coil assembly includes an electromagnetic coil, a coil bobbin wound with the electromagnetic coil and having a flange, a terminal housing molded integrally with the flange of the coil bobbin, a socket or connector constituting parts of the terminal housing, an insulated casing covering the coil bobbin and a cover molded integrally with the insulated casing for covering the terminal housing and receiving the connection terminals to form a male connector terminal.

The electromagnetic coil assembly of the present invention can be assembled easily and reliably without damaging either the electromagnetic coil wound on the coil bobbin or the insulation.

Moreover, because oil will pass into the gap between the coil bobbin and the insulated casing, the heat generated by the electromagnetic coil will be dissipated by the oil, thus enhancing the cooling effect. As a result, it is possible to eliminate the problems associated with electromagnetic valves, which might otherwise occur as the temperature rises.

Moreover, the leads can be wired with an allowance or slack, which allowance provides advantages under severe conditions such as those producing thermal shock.

BRIEF DESCRIPTION OF THE DRAWINGS

The foregoing and other objects and features of the present invention will become apparent from the following description, made with reference to the accompanying drawings, in which.

DESCRIPTION OF THE PREFERRED EMBODIMENTS

Preferred embodiments of the present invention will be described in the following with reference to the accompanying drawings.

Figure 1:
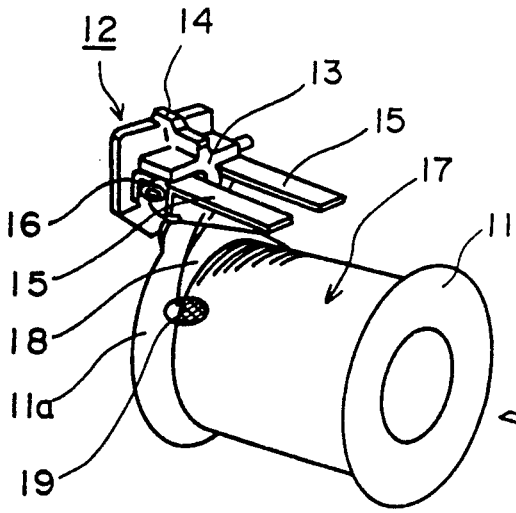
FIG. 1 is a perspective view showing an electromagnetic coil device according to one embodiment of the present invention.

As shown in FIG. 1, a coil bobbin 11 has a flange 11*a* molded integrally with a terminal holder 12. This terminal holder 12 in turn is molded integrally with a grooved partition 13 and a projection 14 to be fitted in a (later-described) casing. Connector terminals 15,15' are mounted on the groove partition 13. An electromagnetic coil 17 has its leads connected with fusing portions 16 which are formed in the bases of the connector terminals 15,15'.

Figure 2:
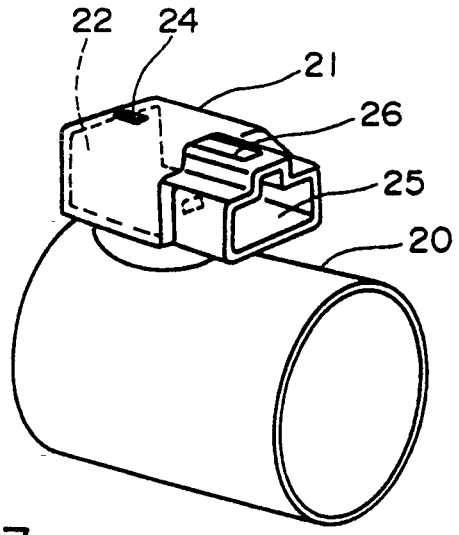
FIG. 2 is a perspective view showing a casing to be fitted on the electromagnetic coil device of FIG. 1.

The casing portion 20 of the assembly is shown in FIG. 2. The insulating casing portion 20 is adapted to cover the coil bobbin 11 and carries an integrally molded terminal housing 21 for covering the terminal holder 12, receiving the terminals 15,15*a* and thereby forming a male connector portion. More specifically, the insulating casing 20 is cylindrical in shape, and the terminal housing 21, formed integrally with the casing 20, is formed with a recess 22 for receiving the terminal holder 12 and a recess 25 which forms the male connector portion.

The specific structures of the individual parts will now be described in detail.

Figure 6:
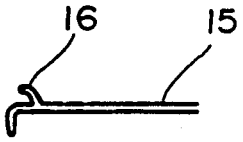
FIG. 6 is a side elevation showing a connector terminal according to the present invention.
Figure 7:
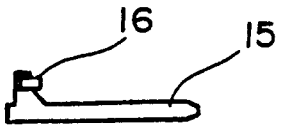
FIG. 7 is a top plan view of the connector terminal of FIG. 6.

The coil bobbin 11 has flange 11*a* formed integrally with the terminal holder 12, which in turn is formed integrally with the grooved partition 13 and the projection 14. In the grooved partition 13, there are mounted the power supply connector terminal 15 and the ground terminal 15', each having a fusing portion 16, as shown in FIGS. 6 and 7. On this coil bobbin 11, as shown in FIG. 1, there is wound the electromagnetic coil 17 which has its leads 18 connected with the fusing portions 16. The leads 18 are fixed with slack and an adhesive 19 of silicone rubber is applied at the points 19 where they exit the electromagnetic coil 17.

Figure 3:
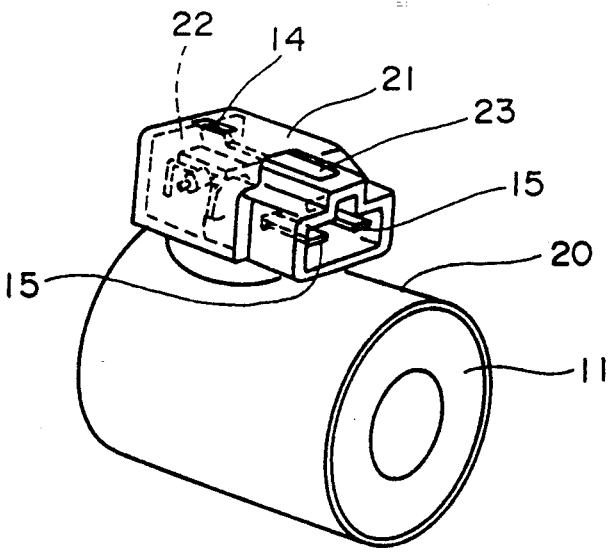
FIG. 3 is a perspective view showing the electromagnetic coil device of FIG. 1 combined with the casing of FIG. 2.
Figure 4:
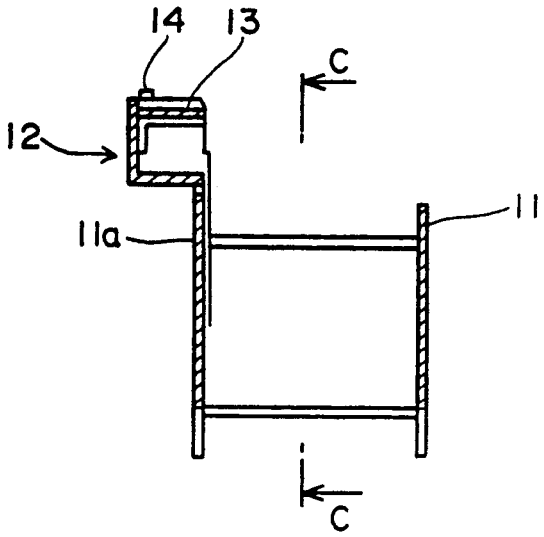
FIG. 4 is a section showing a coil bobbin according to the present invention.
Figure 5:
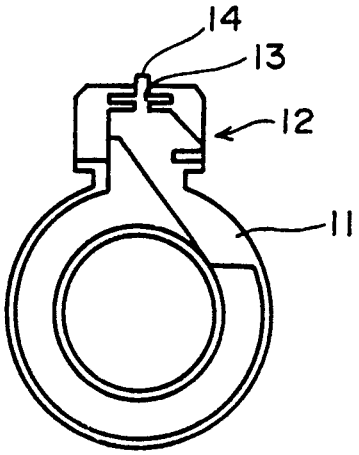
FIG. 5 is a section taken in the direction of arrows C—C of FIG. 4.
Figure 8:
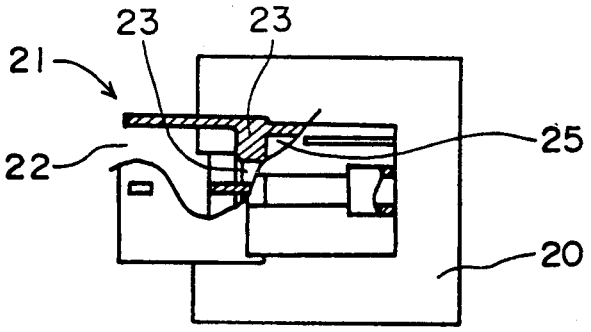
FIG. 8 is a partially broken-away top plan view showing a casing according to the present invention.
Figure 9:
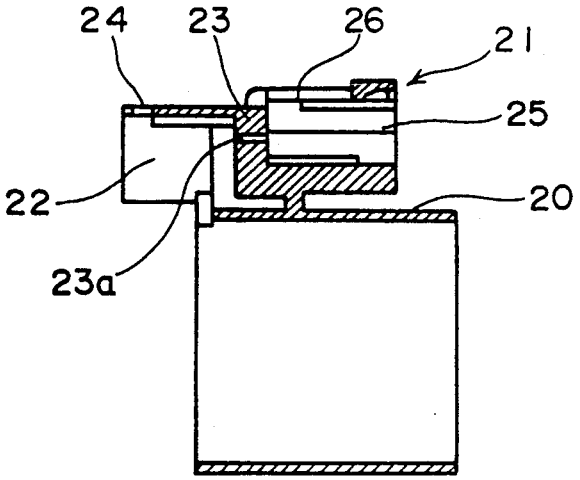
FIG. 9 is an elevational view, in cross-section, showing the casing of FIG. 8.
Figure 10:
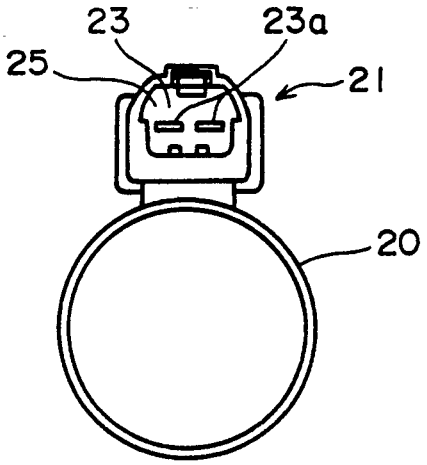
FIG. 10 is a front elevation of the casing of FIG. 9.
Figure 11:
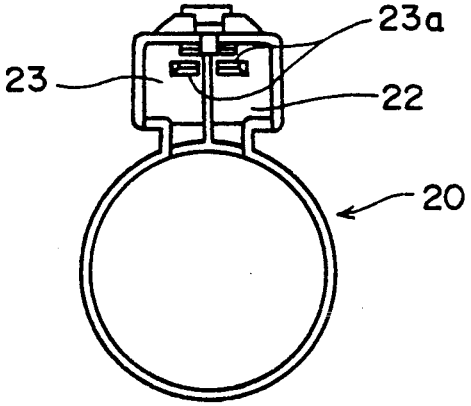
FIG. 11 is a rear elevation of the casing of FIG. 9.

As seen in FIGS. 8 and 9, the terminal housing 21 is partitioned by member 23 to divide housing 21 into a rear chamber 22 for covering the terminal holder 12 and a front chamber 25 forming the male connector portion. The partition 23 is formed with holes 23*a* for passing the terminals 15,15' therethrough. Moreover, the rear chamber 22, formed at the back of the terminal housing 21, is provided with a notch 24 which mates with the aforementioned projection 14 and the front chamber 25 of the terminal housing 21 is provided with a notch 26 designed to mate with a projection on a female connector (not shown) for connection with male connector terminals 15 and 15'. Thus, the electromagnetic coil assembly shown in FIG. 1 and the casing shown in FIG. 2 are combined with each other, as shown in FIG. 3, to a form an electromagnetic coil assembly in accordance with the present invention.

Thus, the present invention offers many advantages, including:

(1) The structure is so simplified that the casing may be easily slipped over the coil bobbin holding the connector terminals, using the connector terminals as guides.

(2) The electromagnetic coil device can be assembled easily and reliably while damaging neither the electromagnetic coil wound on the coil bobbin nor the insulation.

(3) When put in use as an electromagnetic valve in a hydraulic control circuit of an automatic transmission, hydraulic fluid will enter into the gap between the coil bobbin and the casing and will serve to dissipate the heat generated by the electromagnetic coil and thereby provide cooling. This cooling is far more efficient than that for a resin-embedded coil device.

(4) When the coil assembly is used in a hydraulic control circuit for an automatic transmission, the slack leads provide more allowance than a resin-embedded coil device, thereby reducing the danger of thermal shock, even under the most severe conditions.

(5) The coil is protected against loosening of its wire leads and against thermal shock by application of the silicone rubber resin, which resin possesses elasticity and strength against the thermal shock and thus protects the leads of the electromagnetic coil.

Figure 12:
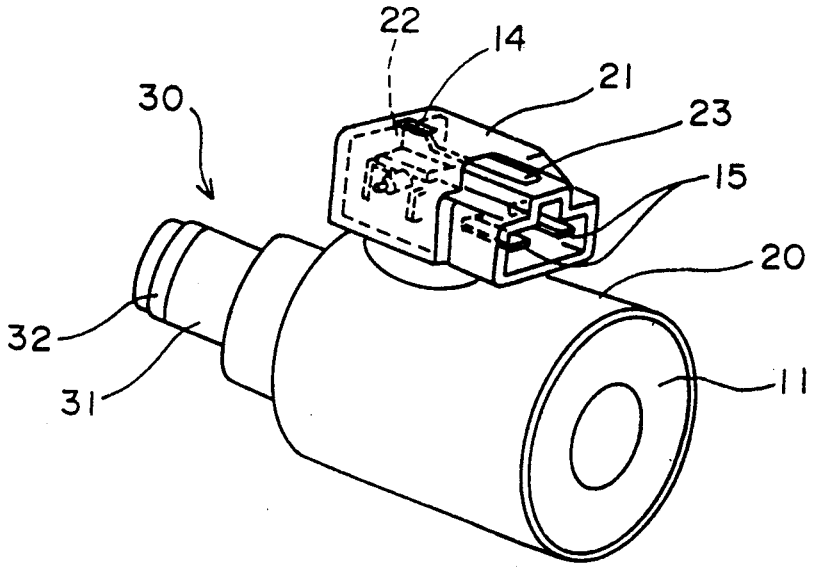
FIG. 12 is a perspective view showing one embodiment of an electromagnetic valve which is assembled with the electromagnetic coil device of the present invention.
Figure 13:
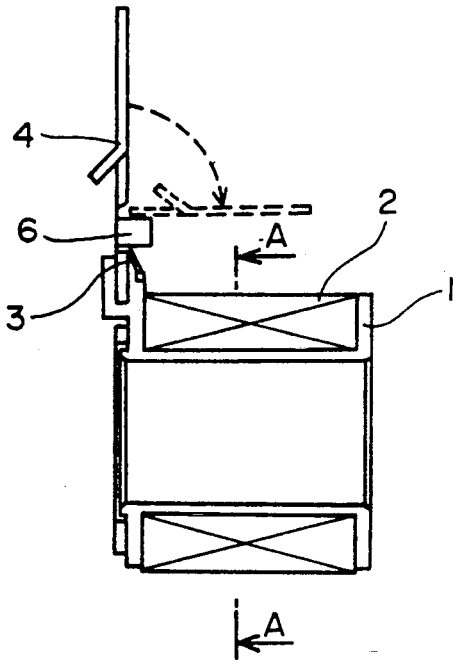
FIG. 13 is a cross-sectional view of an electromagnetic coil device of the prior art before the molding resin is applied.
Figure 14:
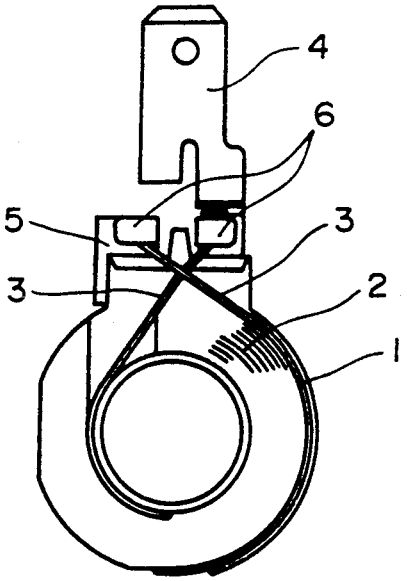
FIG. 14 is a view taken in the direction of arrows A—A of FIG. 13.
Figure 15:
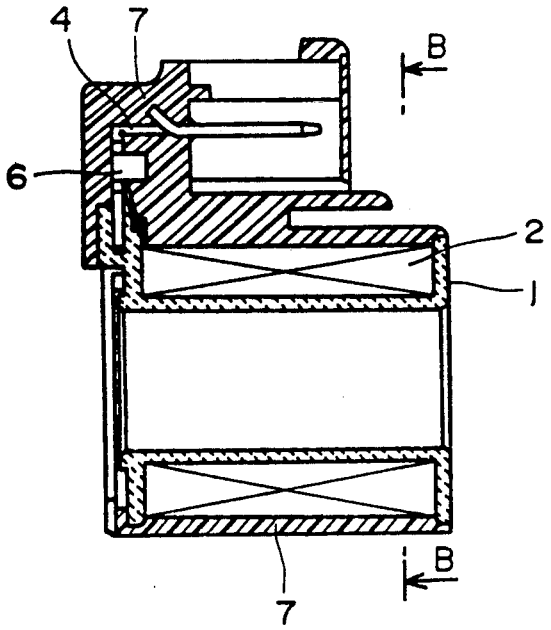
FIG. 15 is a cross-sectional view showing the electromagnetic coil device of FIG. 13 after the resin-molding operation.
Figure 16:
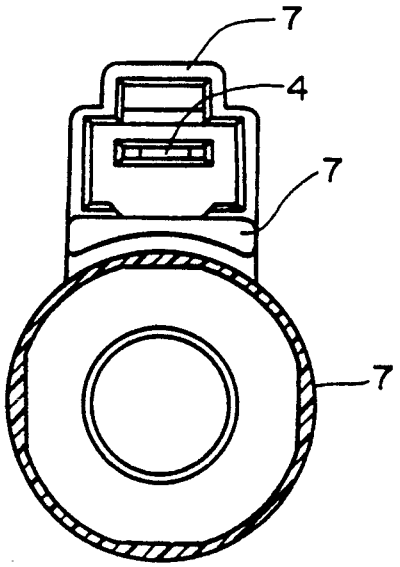
FIG. 16 is a view taken in the direction of arrows B—B of FIG. 15.

FIG. 12 shows the coil assembly of the present invention joined to a valve portion 30. The valve portion includes an outer valve body 31 formed with an input port and a discharge port, an inner valve body (not shown) fitted in the outer valve body and a ball which is positioned responsive to operation of a plunger driven by the electromagnetic coil, thereby opening or closing the oil passage through the valve. Reference numeral 31 designates an O-ring.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A coil assembly for an electromagnetic valve adaptable to a vehicular hydraulic control circuit, said coil assembly comprising:

a coil bobbin having a flange;

an electromagnetic coil wrapped on said coil bobbin and having leads extending from said coil bobbin;

a casing covering said coil bobbin and said coil;

a terminal holder external of said casing, fixed to said flange and receiving said leads;

electrical terminals connected to said leads in said terminal holder and mounted wholly within said terminal holder;

a terminal housing integrally molded with said casing and receiving said terminals to form a male connector external to said casing and wherein said casing is axially slidable with respect to said coil bobbin and said terminal holder and wherein said terminal housing includes a wall portion radially extending relative to the coil and having a pair of apertures for receiving portions of said electrical terminals extending parallel to the axis of said coil and for thereby guiding said casing onto said coil bobbin in assembly.

2. The coil assembly of claim 1 wherein said terminal holder is integrally molded with said flange.

3. The coil assembly of claim 1 additionally comprising adhesive applied to the points where said leads exit said coil.

* * * * *